US006646553B1

(12) United States Patent
Kolton et al.

(10) Patent No.: US 6,646,553 B1
(45) Date of Patent: Nov. 11, 2003

(54) ELECTRONIC ARTICLE SURVEILLANCE MARKER ASSEMBLY

(75) Inventors: Chester Kolton, Westfield, NJ (US); Michael Norman, East Brunswick, NJ (US); Robert Whittemore, Middletown, NY (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

(21) Appl. No.: 10/137,804

(22) Filed: May 2, 2002

(51) Int. Cl.[7] ..... G08B 13/14

(52) U.S. Cl. ..... 340/572.1; 340/572.9; 340/568.1

(58) Field of Search ..... 340/572.1, 568.1, 340/571, 572.8, 572.9, 573.4; 70/57.1, 58

(56) References Cited

U.S. PATENT DOCUMENTS 5,437,172 A * 8/1995 Lamy et al. ..... 70/57.1
5,627,520 A * 5/1997 Grubbs et al. ..... 340/572
5,945,909 A 8/1999 Kolton
5,969,613 A * 10/1999 Yeager et al. ..... 340/572.9

* cited by examiner

*Primary Examiner*—Anh V. La
(74) *Attorney, Agent, or Firm*—Robin, Blecker & Daley

(57) ABSTRACT

An electronic article surveillance marker assembly comprises a housing containing an EAS marker and a strap member having a detent structure at one end thereof and a tail extending from the detent structure to a free end, one side of the tail defining ratchet structure retainable by the detent structure, the detent structure being retained interiorly of the housing, the tail extending outwardly of the housing through a passage formed in a first wall of the housing, the housing defining an opening in a second wall of the housing in registry with the detent structure, the tail free end being movable through the second wall opening into the detent structure to be retained in the housing.

14 Claims, 4 Drawing Sheets

ELECTRONIC ARTICLE SURVEILLANCE MARKER ASSEMBLY

FIELD OF THE INVENTION

This invention relates generally to security from shoplifting of articles of manufacture and pertains more particularly to electronic article surveillance marker assemblies for use with articles of manufacture.

BACKGROUND OF THE INVENTION

One form of electronic article surveillance (EAS) marker in widespread use is in the form of a flat, thin, flexible, rectangular member which is applied adhesively to flat or curved exterior surfaces of articles. One shortcoming of such exterior surface application is that, while often covered by a bar code label, the presence of the EAS marker nonetheless is evident since it is visible from the sides of the bar code label. Still further, the EAS marker is accessible to a customer.

Commonly-assigned U.S. Pat. No. 5,945,909 discloses a so-called "seal" comprising a one-piece body having first and second members closable one upon the other and thereupon respectively defining first and second outer seal walls and a tail peripherally continuous with at least one of the first and second members at a third outer seal wall, the tail having a hook at a free end thereof The seal body defines an interior recess and a detent opening into said third outer seal wall for retentive reception of the tail hook interiorly of the seal. An EAS marker is disposed in the seal body recess and is contained therein between the first and second outer seal walls upon closure of the first and second members.

The '909 patent seal is used by circumscribing a portion of an article, e.g., a watchband, with the tail and then inserting the tail hook into the seal body detent.

The EAS marker is a flat ferromagnetic strip member and is detectable by various known EAS systems, e.g., where the marker is not deactivated (as at an article payment checkout counter) and is carried through EAS marker detection gates at a facility exit.

SUMMARY OF THE INVENTION

The present invention has as its primary object the provision of an improved electronic article surveillance marker assembly.

In attaining this and other objects, the invention provides an electronic article surveillance marker assembly, comprising a housing containing an EAS marker and a strap member having a detent structure at one end thereof and a tail extending from the detent structure to a free end, one side of the tail defining ratchet structure retainable by the detent structure, the detent structure being retained interiorly of the housing, the tail extending outwardly of the housing through a passage formed in a first wall of the housing, the housing defining an opening in a second wall of the housing in registry with the detent structure, the tail free end being movable through the second wall opening into the detent structure to be retained in the housing.

The invention will be further understood from consideration of the following description of preferred embodiments thereof and from the drawings where like reference numerals identify like parts throughout.

DETAILED DESCRIPTION OF THE PREFERRED EMBODIMENT

Figure 3:
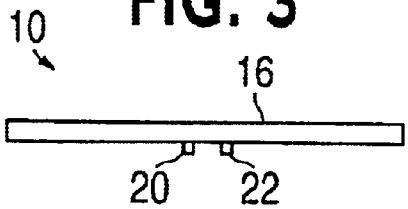
FIG. 3 is a top plan elevation of the FIG. 1 housing member.
Figure 1:
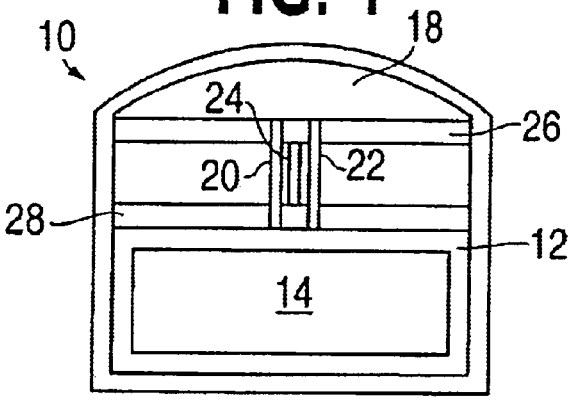
FIG. 1 is a front elevation of a first housing member in accordance with the invention with an EAS marker seated therein.
Figure 2:
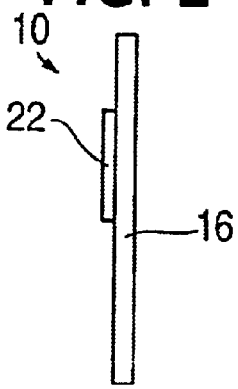
FIG. 2 is right side elevation of the FIG. 1 housing member.
Figure 4:
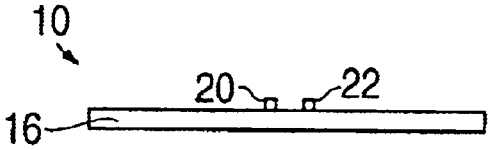
FIG. 4 is a bottom plan elevation of the FIG. 1 housing member.
Figure 7:
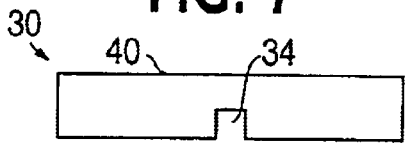
FIG. 7 is a top plan elevation of the FIG. 5 housing member.
Figure 9:
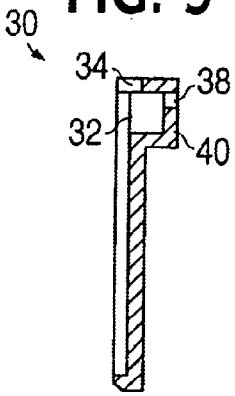
FIG. 9 is a sectional view of the FIG. 5 housing member as would be seen from plane IX—IX of FIG. 5.
Figure 5:
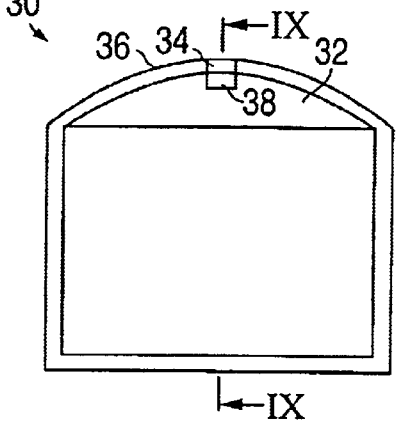
FIG. 5 is a front elevation of a second housing member in accordance with the invention.
Figure 6:
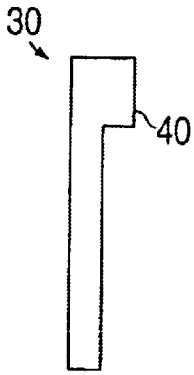
FIG. 6 is right side elevation of the FIG. 5 housing member.
Figure 8:
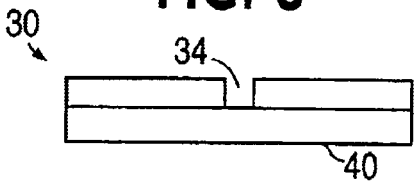
FIG. 8 is a bottom plan elevation of the FIG. 5 housing member.

Referring to FIGS. 1–4, first housing member 10 is comprised of a one-piece plastic body and defines a first compartment (lower recess) 12 in which is disposed EAS marker 14, which is adhesively secured to the interior of wall 16, and a second compartment (upper recess) 18. First and second (outer) ribs 20 and 22 extend between compartments 12 and 18 and project outwardly of wall 16 (FIGS. 2–4). Third (inner) rib 24 extends downwardly of and in parallel with ribs 20 and 22 and, with central portions of housing transverse members 26 and 28, defines a flat surface.

Turning to FIGS. 5–9, second housing member 30 is likewise comprised of a one-piece plastic body and defines a recess 32. Opening 34 extends through wall 36 into recess 32. Passage 38 extends through wall 40 into recess 32.

Figure 10:
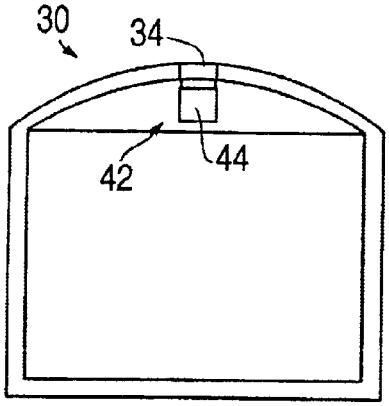
FIG. 10 is a front elevation of the FIG. 5 housing member assembled with a strap member.
Figure 11:
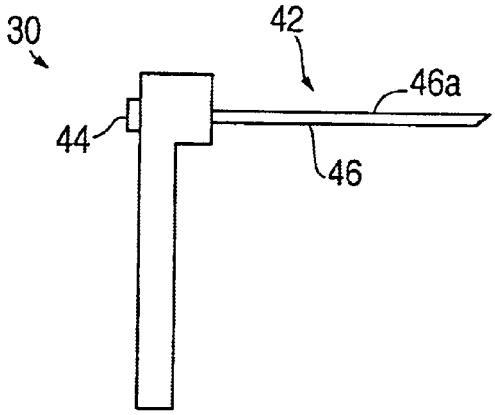
FIG. 11 is a right side elevation of FIG. 10.

In FIGS. 10 and 11, strap member 42 is shown assembled with second housing member 30. Strap member 42 is a one-piece plastic body configured as a cable tie, i.e., having retention structure 44 with a pawl (not shown) formed therein. Tail 46 extends from retention structure 44 to a free end and surface 46*a* has recessed ratchet teeth (not shown) formed thereof In reaching the assembly of FIGS. 10 and 11, the free end of tail 46 is inserted into and through passage 38 until retention structure 44 seats in recess 32, extending outwardly thereof as is seen in FIG. 11, to nest in upper recess 18 of first housing member 10 upon its securement to housing member 30.

Figure 12:
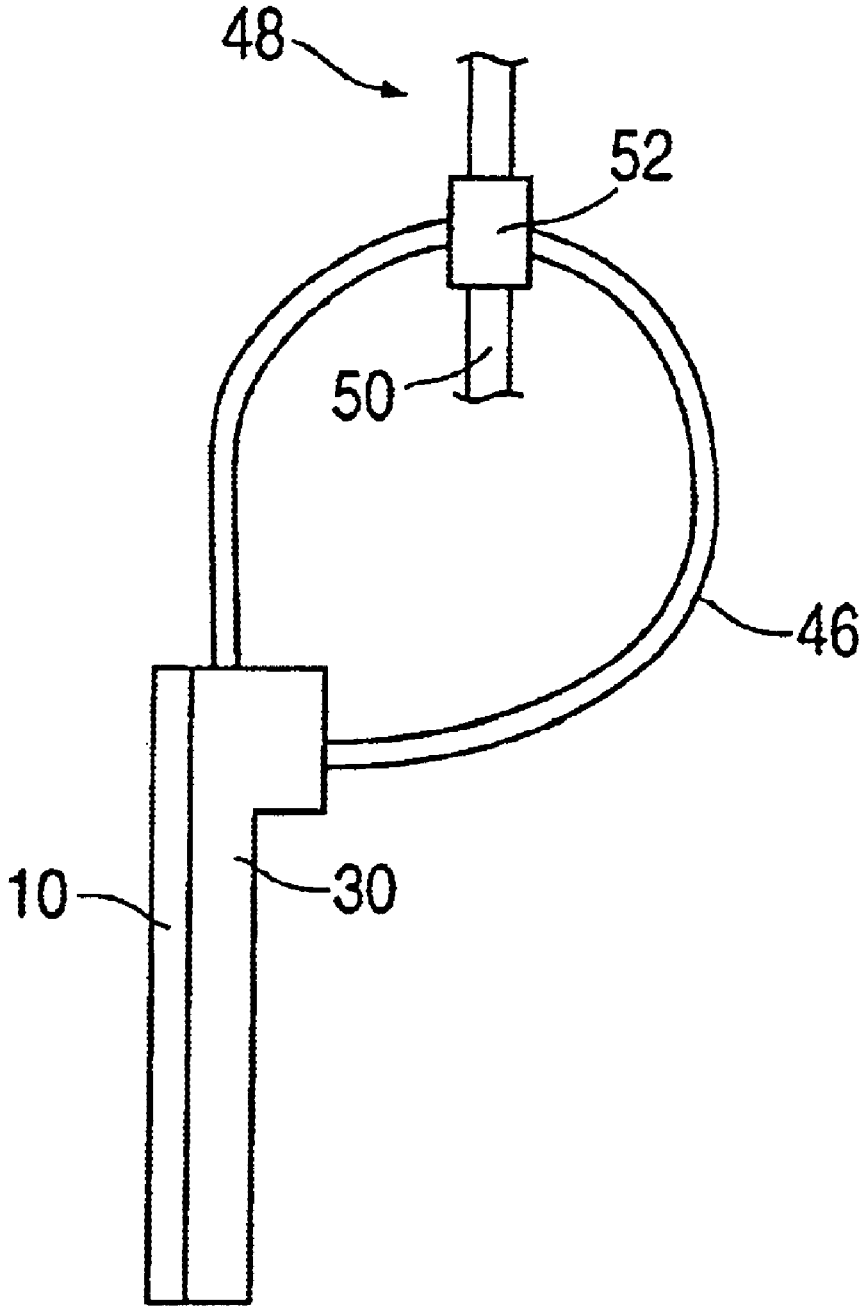
FIG. 12 shows a EAS assembly in accordance with the invention in a state of being retained with an article of manufacture.

Turning now to FIG. 12, first housing member 10 is shown secured to second housing member 30, as by heat-sealing of the perimeters thereof to one another. By way of example, an article of manufacture 48 is shown in pertinent part, i.e., the leather wall 50 of a shoe having lacing eyelet 52. The free end of tail 46 is inserted into and through eyelet 52 and is then inserted into opening 34 and thence into retention structure 44 and ratcheted thereinto until reverse movement of tail 46 is precluded.

The spacing between first and second ribs 20 and 22 is selected to be slightly greater than the width of tail 46, such that the ribs guide the tail free end into the housing 54 formed by joinder of the first and second housing members. Further, the flat surface formed by third rib 24 and central portions of housing transverse members 26 and 28 is spaced below the ends of ribs 20 and 22 by a measure slightly greater than the thickness of tail 46.

In summary of the foregoing and by way of introduction to the ensuing claims, the invention will be seen to provide an electronic article surveillance marker assembly, comprising a housing containing an EAS marker and a strap member having a detent structure at one end thereof and a tail extending from the detent structure to a free end, one side of the tail defining ratchet structure retainable by the detent structure, the detent structure being retained interiorly of the housing, the tail extending outwardly of the housing through a passage formed in a first wall of the housing, the housing defining an opening in a second wall of the housing in registry with the detent structure, the tail free end being movable through the second wall opening into the detent structure to be retained in the housing.

The housing defines first and second compartments, the first compartment containing the EAS marker and the second compartment containing the detent structure. The housing passage and the housing opening extend into the second compartment. The housing defines first and second interior ribs extending between the first and second compartments and spaced from one another by a spacing exceeding a width of the tail. The housing defines a third interior rib between the first and second interior ribs, the tail free end being movable in the housing between the first and second interior ribs and over the third interior rib and the EAS marker.

In the particularly disclosed embodiment, the invention provides an electronic article surveillance marker assembly, comprising a first housing defining a recess, an EAS marker seated in the recess, a second housing defining a recess and having an opening extending through a first wall of the second housing into the second housing recess and having a passage extending through a second wall of the second housing into the second housing recess, and a strap member having a detent structure at one end thereof and a tail extending from the detent structure to a free end, one side of the tail defining ratchet structure retainable by the detent structure, the detent structure being disposed in the second housing recess and the tail extending through the second housing passage with the free end of the tail being disposed outwardly of the second housing, the first and second housings being parametrically secured to one another.

Various changes may be introduced in the disclosed preferred embodiment without departing from the invention. Accordingly, it is to be appreciated that the true spirit and scope of the invention is set forth in the following claims.

What is claimed is:

1. An electronic article surveillance marker assembly, comprising a housing containing an EAS marker and a strap member assembleable with said housing and having a detent structure at one end thereof and a tail extending from said detent structure to a free end, one side of said tail defining ratchet structure retainable by said detent structure, said detent structure being retained interiorly of said housing upon assembly of said strap member with said housing, said tail extending outwardly of said housing through a passage formed in a first wall of said housing, said housing defining an opening in a second wall of said housing in registry with said detent structure, said tail free end being movable through said second wall opening into said detent structure to be retained in said housing.

2. The assembly claimed in claim 1, wherein said housing defines first and second compartments, said first compartment containing said EAS marker and said second compartment containing said detent structure.

3. The assembly claimed in claim 2, wherein said housing passage and said housing opening extend into said second compartment.

4. The assembly claimed in claim 2, wherein said housing defines first and second interior ribs extending between said first and second compartments and spaced from one another by a spacing exceeding a width of said tail.

5. The assembly claimed in claim 4, wherein said housing defines a third interior rib between said first and second interior ribs, said tail free end being movable in said housing between said first and second interior ribs and over said third interior rib and said EAS marker.

6. In combination:

(a) an article of manufacture; and (b) an electronic article surveillance marker assembly, comprising a housing containing an EAS marker and a strap member assembleable with said housing and having a detent structure at one end thereof and a tail extending from said detent structure to a free end, one side of said tail defining ratchet structure retainable by said detent structure upon assembly of said strap member with said housing, said detent structure being retained interiorly of said housing, said tail extending outwardly of said housing through a passage formed in a first wall of said housing, said housing defining an opening in a second wall of said housing in registry with said detent structure, said tail being resident in said article of manufacture, said tail free end being resident in said housing and retained therein by said detent structure.

7. The combination claimed in claim 6, wherein said housing defines first and second compartments, said first compartment containing said EAS marker and said second compartment containing said detent structure.

8. The combination claimed in claim 7, wherein said housing passage and said housing opening extend into said second compartment.

9. The combination claimed in claim 7, wherein said housing defines first and second interior ribs extending between said first and second compartments and spaced from one another by a spacing exceeding a width of said tail.

10. The combination claimed in claim 9, wherein said housing defines a third interior rib between said first and second interior ribs, said tail free end being movable in said housing between said first and second interior ribs and over said third interior rib and said EAS marker.

11. An electronic article surveillance marker assembly, comprising a first housing defining a recess, an EAS marker seated in said recess, a second housing defining a recess and having an opening extending through a first wall of said second housing into said second housing recess and having a passage extending through a second wall of said second housing into said second housing recess, and a strap member assembleable with said first housing and having a detent structure at one end thereof and a tail extending from said detent structure to a free end, one side of said tail defining ratchet structure retainable by said detent structure, said detent structure being disposed in said second housing recess upon assembly of said first housing and said strap member with said second housing and said tail extending through said second housing passage with said free end of said tail being disposed outwardly of said second housing, said first and second housings being perimetrically secured to one another.

12. The assembly claimed in claim 11, wherein said EAS marker is elongate and is disposed in a lower region of said first housing.

13. The assembly claimed in claim 12, wherein said first housing defines first and second A, ribs extending transversely of said EAS marker and spaced from one another by a spacing exceeding a width of said tail.

14. The assembly claimed in claim 13, wherein said first housing defines a third rib extending between and in parallel with said first and second ribs, said tail free end being movable between said first and second ribs and over said third rib and said EAS marker.

* * * * *